US005415403A

United States Patent [19]

Ritchie et al.

[11] Patent Number: 5,415,403

[45] Date of Patent: May 16, 1995

[54] MAGNETIC BALL LOCK FOR A PINBALL GAME

[75] Inventors: Steve Ritchie, Evanston; Carl A. Biagi, Chicago, both of Ill.

[73] Assignee: Williams Electronics Games, Inc., Chicago, Ill.

[21] Appl. No.: 260,715

[22] Filed: Jun. 16, 1994

[51] Int. Cl.[6] ..... A63F 7/30

[52] U.S. Cl. ..... 273/121 A; 273/119 A; 273/127 R; 273/129 R

[58] Field of Search ..... 273/118–125, 273/127 R, 127 B, 127 C, 129 R, 129 S, 129 A

[56] References Cited

U.S. PATENT DOCUMENTS

| | | | |
|---|---|---|---|
| 2,201,446 | 5/1940 | Moloney et al. | 273/118 A |
| 2,226,885 | 12/1940 | Williams et al. | 273/121 A |
| 4,256,307 | 3/1981 | Brooks | 273/118 A |
| 4,437,664 | 3/1984 | Wiczer et al. | 273/121 A |
| 5,158,291 | 10/1992 | Biagi et al. | 273/127 R X |

*Primary Examiner*—Raleigh Chiu
*Attorney, Agent, or Firm*—Rockey, Rifkin and Ryther

[57] ABSTRACT

The play feature of the invention comprises a ball well and electromagnetic coil. A ball sensor is located near the well entrance to signal when a ball is detected. The electromagnet, disposed at the well entrance, attracts the ball from the playfield into the well where it is retained. To eject the ball, the magnet is reenergized and the ball is ejected form the well onto the playfield.

7 Claims, 2 Drawing Sheets

MAGNETIC BALL LOCK FOR A PINBALL GAME

BACKGROUND OF THE INVENTION

The invention relates generally to pinball games and, more particularly, to an improved ball lock for such games.

A typical pinball game includes an inclined playfield supporting a rolling ball, player operated flippers and a plurality of play features. The game player controls flippers to propel the ball across the playfield. By properly manipulating the flippers, the player can direct the ball at desired play features to control play of the game and to score points.

Player interest in pinball games is increased by providing novel play features that challenge the player's skill, are visually stimulating and enhance scoring possibilities. One such play feature is the so-called "ball lock." Ball locks typically consist of a mechanical device into which the ball rolls and where it remains until it is ejected by a solenoid operated kicker or similar device.

Ball locks are commonly used to provide multiple ball play where a first ball is captured while play of the game continues with a second ball. The first ball may be ejected from the ball lock such that both the first and second balls are in play simultaneously thereby creating multiple ball play.

While existing electromechanical ball locks perform adequately, it is desired to create a new, simplified ball lock.

SUMMARY OF THE INVENTION

The play feature of the invention includes an electromagnetic coil disposed adjacent a path of travel of a ball. A ball sensor, located in the path of travel, generates a signal when a ball is detected approaching the ball lock. The game microprocessor pulses the electromagnet in response to the signal to magnetically attract the ball from the ball path into a well where it is retained until ejected. Energizing the electromagnet a second time removes the ball from the ball lock and propels it back onto the playfield.

DESCRIPTION OF A PREFERRED EMBODIMENT

Figure 1:
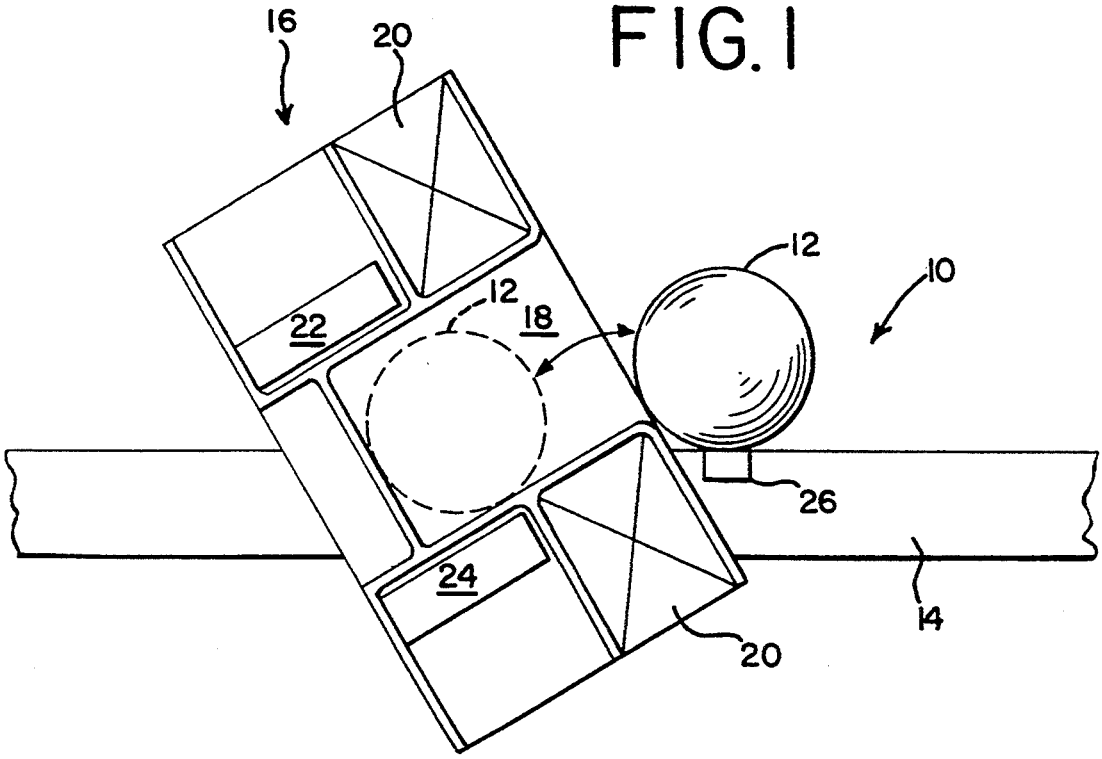
FIG. 1 is a side section-view of the magnetic ball-lock of the invention.

Referring to FIG. 1, the magnetic ball-lock of the invention is shown located adjacent a path of travel 10 of a ferromagnetic pinball 12 on playfield 14. The path of travel can be defined by a chute, ramp, ball lane or the playfield itself. The magnetic ball lock 16 consists of a housing having a receiving well 18 for receiving the ball 12 and an electromagnet 20. The housing is disposed such that the well is at a shallow angle relative to the playfield as shown in FIG. 1. As a result, a ball that enters the well will remain there until it is forcibly ejected.

An optical sensor including a light emitter 22 and light detector 24 is operatively disposed near the bottom of well 18 such that it can detect the presence or absence of a ball therein. While an optical sensor is illustrated, it will be appreciated that any sensor capable of detecting the presence or absence of a pinball can be used such as eddy sensors or contact switches. Located adjacent the ball lock in operative relation to the ball path is a second ball sensor 26. Sensor 26 may consist of an optical switch or other ball sensor and is positioned (for example, embedded in the playfield) to detect the ball as it approaches the ball lock.

The electromagnet 20 consists of a wire coil that surrounds the ball well 18 at the entrance thereto. The coil is connected to the game control system to permit it to be selectively energized to attract the ferromagnetic pinball.

Figure 2:
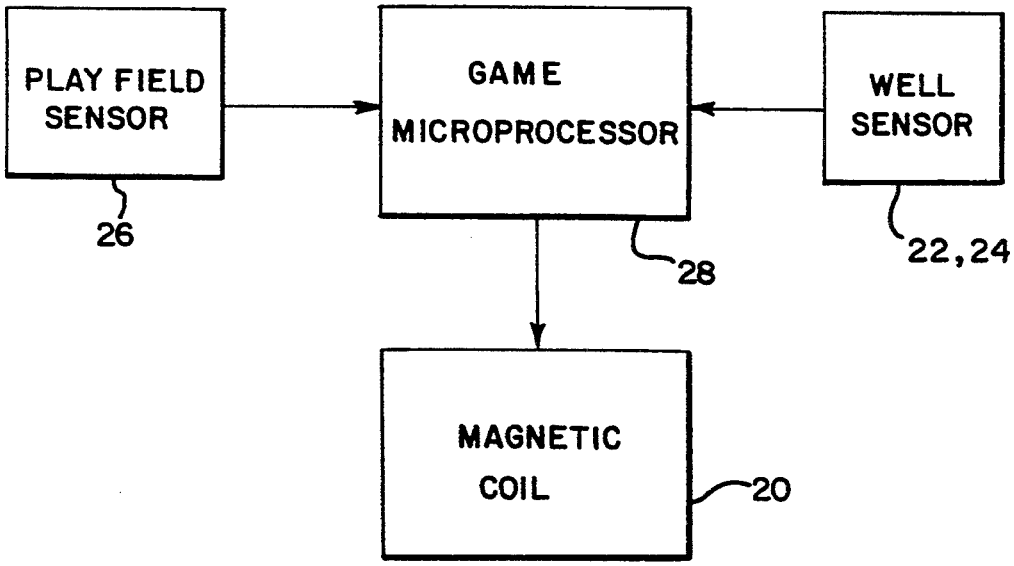
FIG. 2 is a block diagram showing the electrical connections of the magnetic ball lock.

FIG. 2 is a block diagram which illustrates the electrical connections of the ball lock with a pinball game. When a pinball approaches the ball lock, playfield sensor 26 signals the game microprocessor when it may energize magnet 20 to "pull" the ferromagnetic pinball from the playfield into well 18. The processor may do so by energizing magnet 20 via the usual device drivers associated with a modern pinball game.

Figure 3:
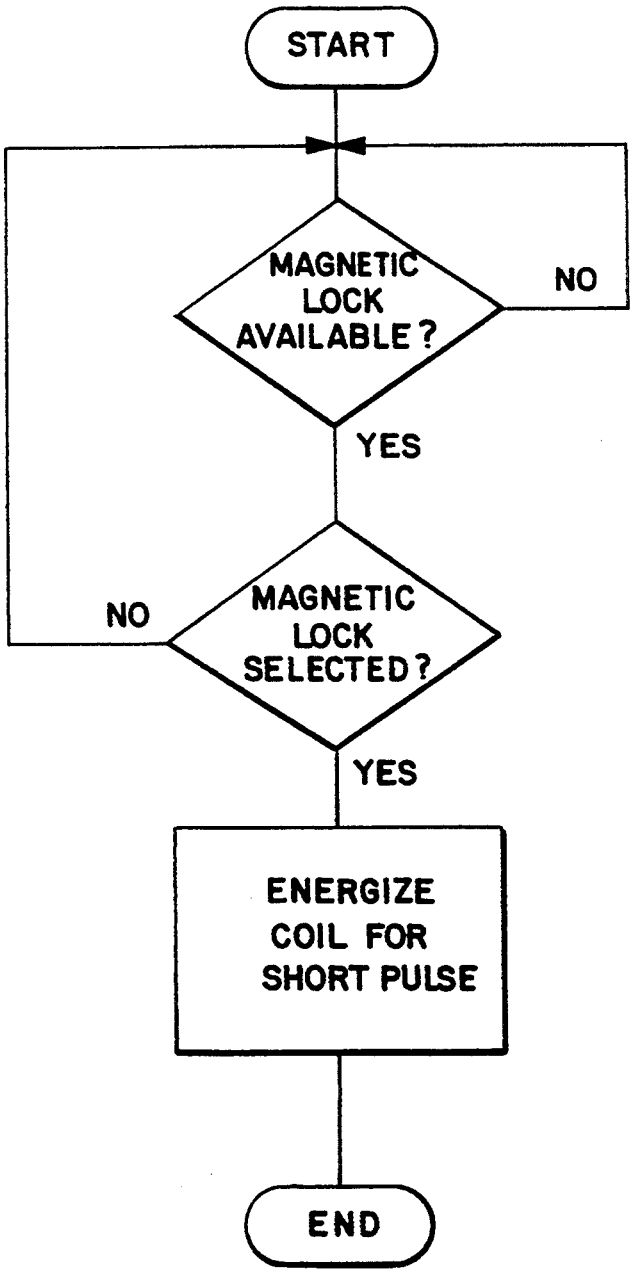
FIG. 3 is a flow diagram illustrating the operation of the magnetic ball lock by the game microprocessor.

In operation, the game microprocessor 28 determines whether the ball lock is "available" (FIG. 3). The ball lock is "available," for example, if there is no ball in well 18, this being determined by the status of the sensor 22 and 24.

If the ball lock is available, the microprocessor determines if the ball lock has been "selected" based on the game program. For example, the game program can make the ball lock available only after the player obtains a predetermined score or achieves a predetermined game objective.

If the ball lock is available and selected, it is capable of receiving a pinball. When a ball 12 approaches the ball lock along ball path 10, the ball sensor 26 detects the ball and sends a signal to the game microprocessor 28. In response thereto, microprocessor 28 energizes magnet 20 for a brief pulse to pull the pinball from the path of travel into well 18. Because magnet 20 is energized briefly, the magnetic field is off after the ball begins to move into the well. Its momentum carries the ball into the back of the well. Once the ball is disposed in the well, the ball sensor 22, 24 signals the game microprocessor indicating the presence of the ball, thereby rendering the ball lock unavailable.

The ball is retained in well 18 until the game program calls for its ejection. For example, it can be ejected while a second ball is in play to create multiple ball play or it can be ejected to give the player a "bonus" ball. To eject the ball, the magnet is again briefly pulsed by the microprocessor. When the magnet is pulsed, the ball will be drawn from the well towards the magnet.

The pulse duration is carefully selected, such that when the ball begins to move, the electromagnet is deenergized, the ball's momentum carrying it from well 18 onto the playfield. If the pulse is too short, the ball will not get over the lip of the well. If the pulse is too long, the ball will stop at the center of magnet 20 again preventing it from leaving the well. A pulse of proper length, however, will energize the magnet to start the ball in motion and deenergize the magnet before the ball reaches its center thereby allowing the ball's momentum to propel it back onto the playfield.

The required pulse length is determined empirically as it depends on a number of factors including coil size, the number of windings, well dimensions and ball size.

It is easily determined, however, by simple testing. The pulse duration is slowly increased from 0 until it successfully propels the ball out of the well. This setup routine can be programmed into the game for automatic determination of the required pulse duration. For a device according to the teachings of this invention, a pulse of at least one second is typical for drawing a ball into the well and a pulse of 50 msec is typical for discharging the ball back onto the playfield.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A ball lock for a game having a playfield on which at least one ferromagnetic ball can roll comprising:

a) a housing defining a well including an entrance thereto, said well adapted to receive a ball from said playfield via said well entrance; and b) electromagnet means, disposed in operative relation to said well, for attracting a ball toward said well entrance when energized, whereby if the electromagnet means is briefly energized when a ball is on the playfield, it diverts the ball into the well and if it is energized when a ball is in the well, it propels the ball back onto the playfield.

2. The ball lock according to claim 1 further including a sensor for detecting and signalling that a ball is near the ball lock.

3. The ball lock according to claim 1 further including a sensor for detecting and signalling the presence of a ball in said well.

4. In combination, a microprocessor controlled game and a ball lock for selectively receiving from and discharging a ball to the playfield under processor control, said combination comprising:

a) at least one ferromagnetic ball;

b) an inclined playfield;

c) a housing defining a well including an entrance thereto, said well disposed to receive a ball from said playfield via said well entrance;

d) electromagnet means, disposed on said housing in operative relation to said well, for attracting a ball toward the well entrance when energized; and e) a microprocessor controller for briefly energizing said electromagnetic means, whereby if the electromagnet means is briefly energized when a ball is on the playfield, it diverts the ball from the playfield into the well and if it is energized when a ball is in the well, it propels the ball back onto the playfield.

5. The combination of claim 4 further including a sensor for detecting and signalling that a ball is on the playfield near the ball lock.

6. The combination of claim 4 further including a sensor for detecting and signalling the presence of a ball in the well.

7. A ball lock for a game having a playfield on which at least one ferromagnetic ball can roll comprising:

a) a housing defining a well including an entrance thereto, said well adapted to receive a ball via said well entrance from said playfield;

b) electromagnet means, disposed in operative relation to said well, for attracting a ball towards said well entrance when energized;

c) first means for detecting a ball near the housing entrance;

d) second means for detecting a ball disposed in the well;

e) means for briefly energizing said electromagnetic means to:

i) divert a ball into the well responsive to said first means for detecting and to ii) release a ball from the well responsive to said second means for detecting.

* * * * *